US006407509B1

(12) United States Patent
Ikeda et al.

(10) Patent No.: US 6,407,509 B1
(45) Date of Patent: Jun. 18, 2002

(54) PLASMA DISPLAY PANEL

(75) Inventors: Yuichi Ikeda; Masayuki Shibata, both of Hitachi; Hideshi Fukumoto, Hitachinaka; Keizo Suzuki, Tokyo; Masaji Ishigaki, Yokohama, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/695,138

(22) Filed: Oct. 25, 2000

(30) Foreign Application Priority Data

Oct. 25, 1999 (JP) ..... 11-301986

(51) Int. Cl.[7] ..... G09G 3/10

(52) U.S. Cl. ..... 315/169.4; 315/169.1; 313/582; 313/584; 345/55; 345/63; 345/67

(58) Field of Search ..... 315/169.4, 169.1, 315/169.3; 313/582, 584, 586, 587, 590; 345/55, 63, 67

(56) References Cited

U.S. PATENT DOCUMENTS 5,736,815 A * 4/1998 Amemiya ..... 313/586
5,742,122 A * 4/1998 Amemiya et al. ..... 313/582
6,034,474 A * 3/2000 Ueoka et al. ..... 313/584
6,242,859 B1 * 6/2000 Betsui et al. ..... 313/586

FOREIGN PATENT DOCUMENTS

JP 5-41165 * 2/1993
JP 5-307935 * 11/1993

* cited by examiner

*Primary Examiner*—Don Wong
*Assistant Examiner*—Tuyet T. Vo
(74) *Attorney, Agent, or Firm*—Antonelli, Terry, Stout & Kraus, LLP

(57) ABSTRACT

A plasma display panel has a first substrate including a first dielectric layer which covers a plurality of address electrodes; back face barrier ribs, each of which is located between two neighboring address electrodes; a fluorescent layer which covers the back face barrier ribs and the first dielectric layer; and a second substrate including plural pairs of X sustain electrodes and Y sustain electrodes, which are arranged to cross at right angles to the address electrodes, and a second dielectric layer which covers the sustain electrodes. The first substrate is arranged opposite to the second substrate via a discharge space which is filled with gas for radiating ultraviolet rays to make the fluorescent layer emit light and buffer gas, and the thickness of the second dielectric layer in the second substrate is set to be larger at a portion between the X and Y sustain electrodes.

12 Claims, 6 Drawing Sheets

PLASMA DISPLAY PANEL

BACKGROUND OF THE INVENTION

The present invention relates to a plasma display panel (hereafter abbreviated to PDP), and especially to a PDP in which the strength of luminescence per unit of injected energy, that is, the discharge efficiency, is improved, and which can display a bright and clear image with low consumption of power.

The AC surface-discharge type PDP with a three electrode structure, such as that disclosed in Japanese Patent Application Laid-Open Hei 5-307935, is a typical conventional PDP. This type of PDP includes a top face glass substrate and a back face glass substrate. Inside the top face glass substrate, plural pairs of X sustain electrodes and Y sustain electrodes are formed, each electrode consisting of a transparent electrode and a bus electrode. These electrodes are named X electrodes and Y electrodes, or the sustain electrodes in general. The sustain electrodes are covered with a dielectric material layer made of various kinds of material. Foundations and a plurality of address electrodes are situated on the back face glass substrate, and are covered with a dielectric material and a fluorescent material. Each address electrode is partitioned by two partition parts. The top and back face glass substrates are assembled so that the gap between the two substrates is kept constant, and the discharge space between the substrates is filled with a mixed gas whose main component is a rare gas, such as Ne, Xe, etc. Xe is a gas which radiates ultraviolet rays for making the fluorescent material emit light, and Ne is a buffering gas. Thus, when a discharge for displaying an image occurs, visible light is radiated from the fluorescent material via the top face glass substrate. A screen is composed of many pixels, and each pixel includes three discharge cells in which red, green, and blue fluorescent substances are employed, respectively. A PDP with the above structure is called a three-electrode surface-discharge type PDP.

In a typical method of driving the three-electrode surface-discharge type PDP, the PDP is driven by a drive frame of 16.7 ms, which is divided into a plurality of subfields. Each subfield is composed of a reset discharge period in which wall charges in all cells are extinguished; an addressed-cell discharge period in which wall charges are formed only in cells on which image data are to be displayed according to a display control signal; and a sustain discharge period in which the discharge in the addressed cell is maintained according to the image data while using the formed wall charges. A multi-gradation display is implemented by changing the length of the sustain discharge period in each subfield, and a full-color display is realized by combining discharges in three cells in which red, green, and blue fluorescent substances are applied, respectively.

Another type of conventional PDP, that is, an AC driven subrib type PDP of two-electrode structure, is disclosed, for example, in Japanese Patent Application Laid-Open Hei 5-41165. In this structure, two sustain electrodes are arranged perpendicular to each other, so as not to contact each other, in the dielectric material layer in the back plate. There are no address electrodes, and the addressed discharge is generated between the pair of sustain electrodes. Each cell is partitioned by barrier ribs, and fluorescent material is applied on the barrier ribs. Further, other barrier subribs lower than the above barrier ribs, project to the discharge space from the back plate, and fluorescent material is also applied on these barrier subribs. In the same manner as the three-electrode surface-discharge type PDP, the top and back face glass substrates are assembled so that the gap between these substrates is kept constant, and the discharge space between the substrates is filled with a mixed gas whose main component is a rare gas, such as Ne, Xe, etc. When the discharge for image-displaying occurs, visible light is radiated from the fluorescent material through the front plate. This structure is designed to improve the brightness by elongating the discharge path and increasing the surface area of the fluorescent material. A PDP having the above structure is simply referred to as a two-electrode subrib type PDP.

Since there is no address electrode in the two-electrode subrib type PDP, its drive method is different from that of the three-electrode surface-discharge type PDP. However, the drive method of the two-electrode subrib type PDP is not described in Japanese Patent Application Laid-Open Hei 5-41165. Further, the two-electrode subrib type PDP has not come into practical use as yet.

On the other hand, although the three-electrode surface-discharge type PDP has come into practical use, and has been manufactured already, improvement of the brightness and reduction of the power consumption have been important objectives for this type of PDP. That is, the main design objective of this type of PDP is to improve the discharge efficiency (the ratio of the energy emitted as ultraviolet rays to the energy injected into a cell).

SUMMARY OF THE INVENTION

An object of the present invention is to provide a PDP which can stably display an image with high brightness, high gradation, and low power consumption.

Further, another object of the present invention is to improve the discharge efficiency of a PDP.

To achieve the foregoing objects of this invention, the present invention provides a plasma display panel comprising: a first substrate including a first dielectric material layer which covers a plurality of address electrodes; back face barrier ribs, each of which is located between two neighboring address electrodes; a fluorescent material layer which covers the back face barrier ribs and the first dielectric material layer; and a second substrate including plural pairs of X sustain electrodes and Y sustain electrodes, which are arranged so as to cross at right angles relative to the address electrodes; and a second dielectric material layer which covers the sustain electrodes. The first substrate is arranged opposite to the second substrate via a discharge space which is filled with a gas for radiating ultraviolet rays, to make the fluorescent material layer emit light, and a buffer gas, and the thickness of the second dielectric layer in the second substrate is set larger, at a portion between the X and Y sustain electrodes, than that at other portions in the second dielectric layer, that is, a dielectric material barrier rib of appropriate height is provided in a region between each pair of X and Y sustain electrodes. By forming this dielectric material barrier rib, since it is possible to avoid using the region between the X and Y sustain electrodes, in which the electric field is very strong, it is possible to effectively make the electrode field more uniform. Further, it is desirable to use a coplanar electrode configuration, obtained by bending a discharge cell composed of a pair of electrodes opposite to each other at its middle position so that the pair of electrodes are arranged on the same plane. In this coplanar configuration, since it is possible to take advantage of the discharge of opposed electrodes in the sustain discharge, improvement of the discharge efficiency becomes possible by increasing the partial pressure of gas for radiating ultraviolet rays without increasing the operating voltage of the discharge cell.

It is a known fundamental physical phenomenon that the discharge efficiency is improved as the partial pressure of gas for radiating ultraviolet rays is increased. However, if an attempt is made to improve the discharge efficiency in the conventional three-electrode surface discharge type PDP by simply increasing the partial pressure of such gas, it will be found that the operating voltage in the sustain discharge exceeds a practical range.

Also, it is known that if the conditions of the partial pressure of gas for radiating ultraviolet rays; the discharge-gap length; the voltage applied between the electrodes; etc., are the same, then the operating voltage in the sustain discharge between a pair of electrodes disposed opposite to each other (hereafter referred to as discharge in the opposed electrodes) is lower than the operating voltage in the sustain discharge between a pair of electrodes arranged in the same plane (hereafter referred to as surface discharge in the coplanar electrodes). Since the surface discharge in the coplanar electrodes is adopted in the conventional three-electrode surface discharge type PDP, the operating voltage is comparatively high.

Thus, if the advantage of the discharge in the opposed electrodes can be incorporated into the three-electrode surface discharge type PDP in accordance with the present invention, it will improve the discharge efficiency by increasing the partial pressure of gas for radiating ultraviolet rays without increasing the operating voltage.

DETAILED DESCRIPTION OF THE EMBODIMENTS

Hereafter, details of the embodiments will be explained with reference to the drawings, while the structure of a reference PDP discharge cell, the structure of an embodiment in which a dielectric barrier rib is formed and its effects, effects of the increase in partial pressure of gas which radiates ultraviolet rays, etc., will be explained.

Figure 2:
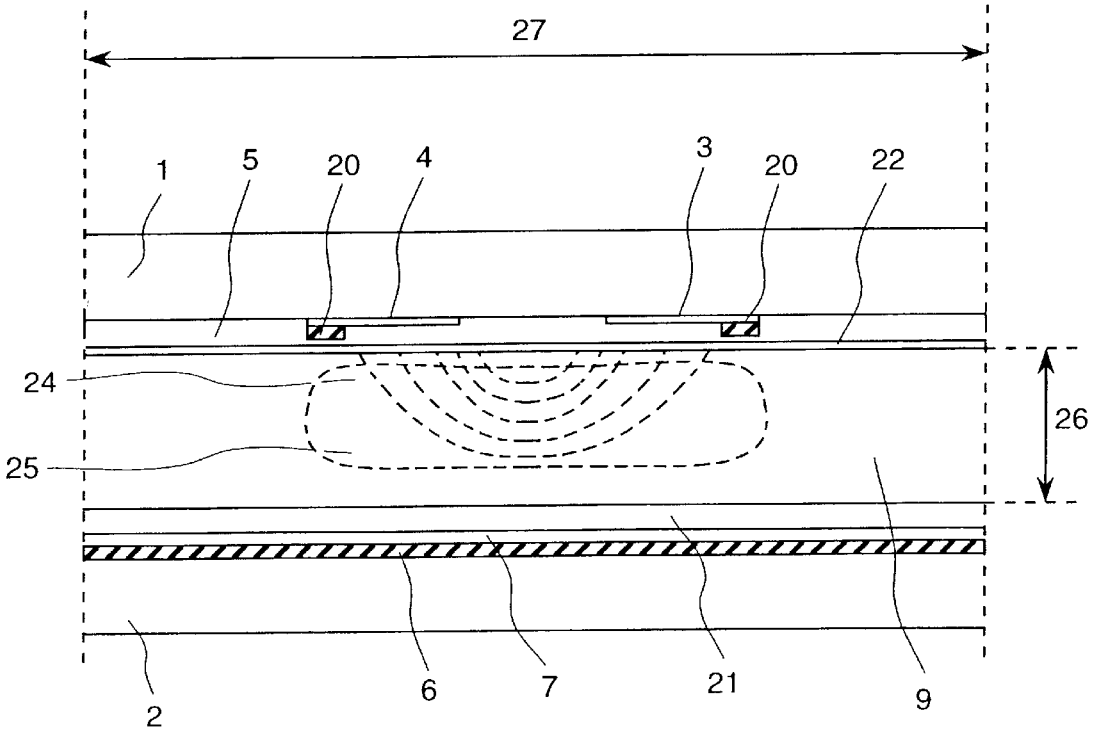
FIG. 2 is a vertical cross sectional view of a discharge cell in a reference PDP for comparison with the PDP according to the present invention.

FIG. 2 shows a vertical cross sectional view of a discharge cell in a reference PDP which will be compared with the PDP according to the present invention. In the structure shown in FIG. 2, the surfaces, facing the discharge space 9, of the top and back face glass substrates 1 and 2, are flat. Further, in the discharge cell of the reference structure shown in FIG. 2, surface discharge plasma is formed parallel to the surface of the secondary electron-emitting layer 22. Since the region with high density plasma within such surface discharge plasma is spaced from the surface of the fluorescent layer, it has the advantage of causing less damage, due to ions, to the fluorescent layer. In this structure, if the discharge space 9 is filled with Xe of 18 Torr as a gas for radiating ultraviolet rays, and Ne of 300 Torr as a buffer gas, the discharge efficiency in the sustain discharge is as low as about 300 Torr. The partial pressure of Xe gas for radiating ultraviolet rays is determined by a practical upper limit of the voltage applied to the sustain electrodes, and the upper limit of this partial pressure has been 300 Torr. A large part (about 95%) of the injected power becomes kinetic energy of ions, which increases the temperature of the display panel.

Figure 3:
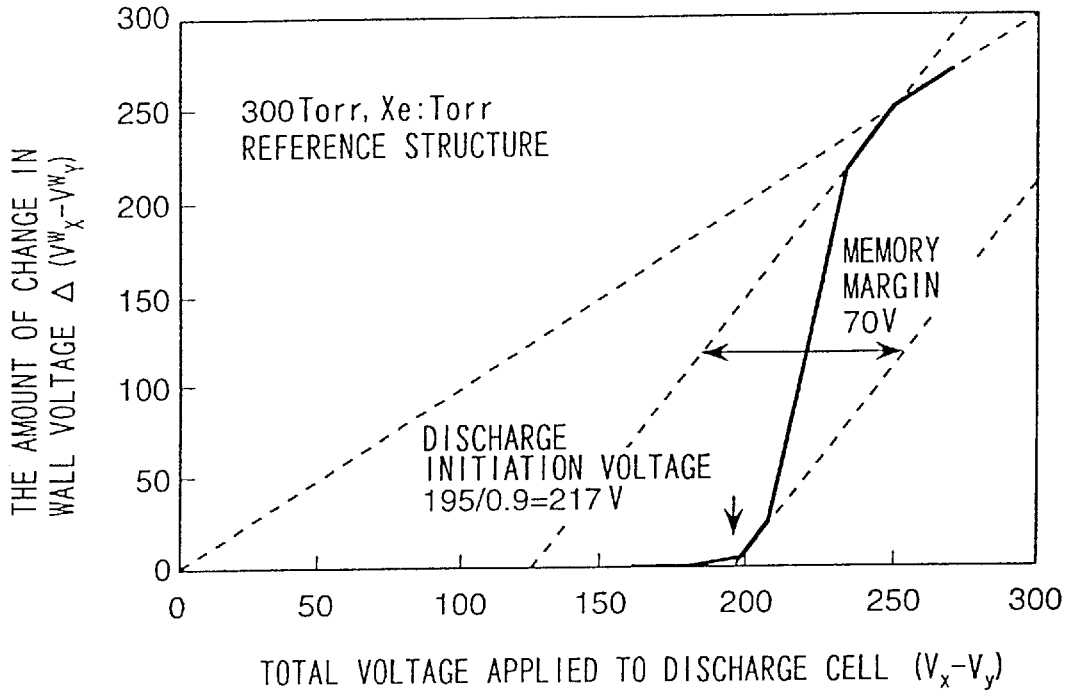
FIG. 3 is a graph indicating the change in the wall voltage of the sustain discharge under the condition of 18-Torr Xe partial pressure, in the structure shown in FIG. 2.

FIG. 3 shows a graph of the change in the wall voltage in the sustain discharge under the condition of 18-Torr Xe partial pressure, in the reference structure shown in FIG. 2. In this figure, the abscissa axis indicates the total voltage (Vx−Vy) applied between the two sustain electrodes, which is due to the voltage of the electrodes and the wall voltage, and the ordinate axis indicates the change $\Delta(V^Wx-V^Wy)$ in the wall voltage between the sustain electrodes. This graph shows the characteristic curve of the discharge cell, and the discharge initiation voltage, the memory margin, and the operating voltage can be seen from this curve. Thus, from FIG. 3, the discharge initiation voltage, the memory margin, and the operating voltage are about 195V, 70V, and 160V (a middle value of 125V–195V), respectively. Further, the discharge initiation voltage is determined as being about 217V by correcting 195V with a voltage drop in the dielectric layer. Also, the operating voltage is determined as being 178V by correcting 160V with a voltage drop in the dielectric layer. For the comparison with the embodiments, the Xe partial pressure of 18 Torr, the operating voltage of 160V, and the discharge efficiency of 5% are assumed as reference values of the reference structure shown in FIG. 2.

Figure 1:
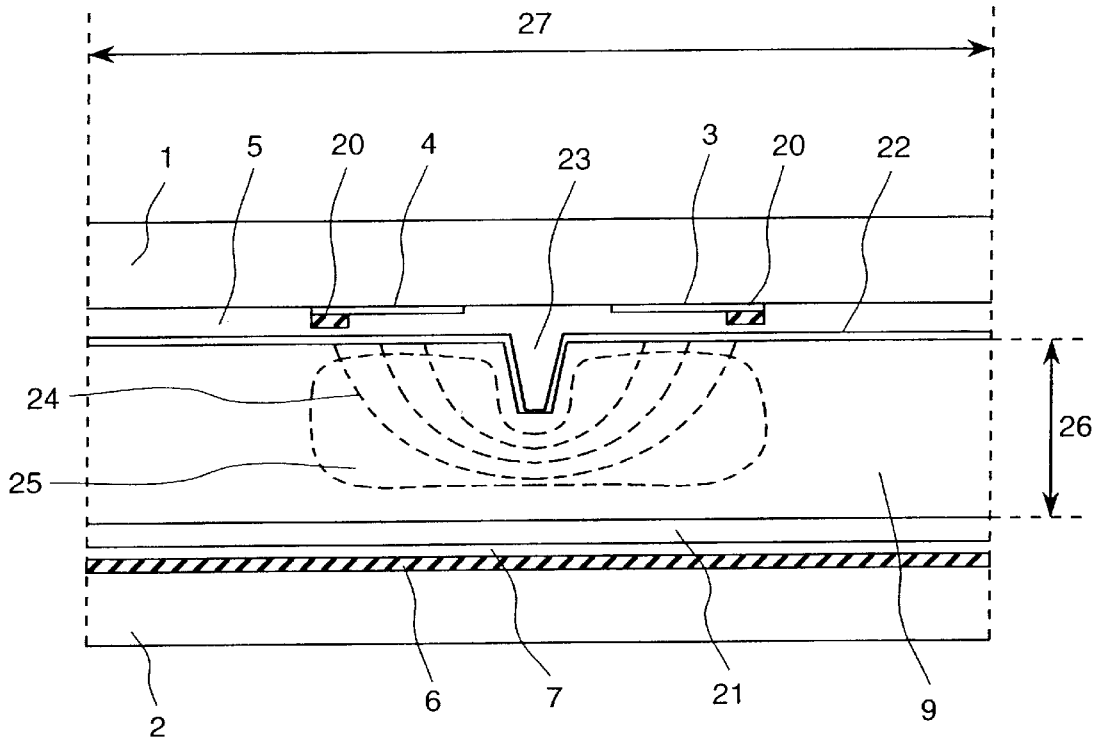
FIG. 1 is a vertical cross sectional view of a discharge cell in a PDP representing an embodiment according to the present invention.
Figure 7:
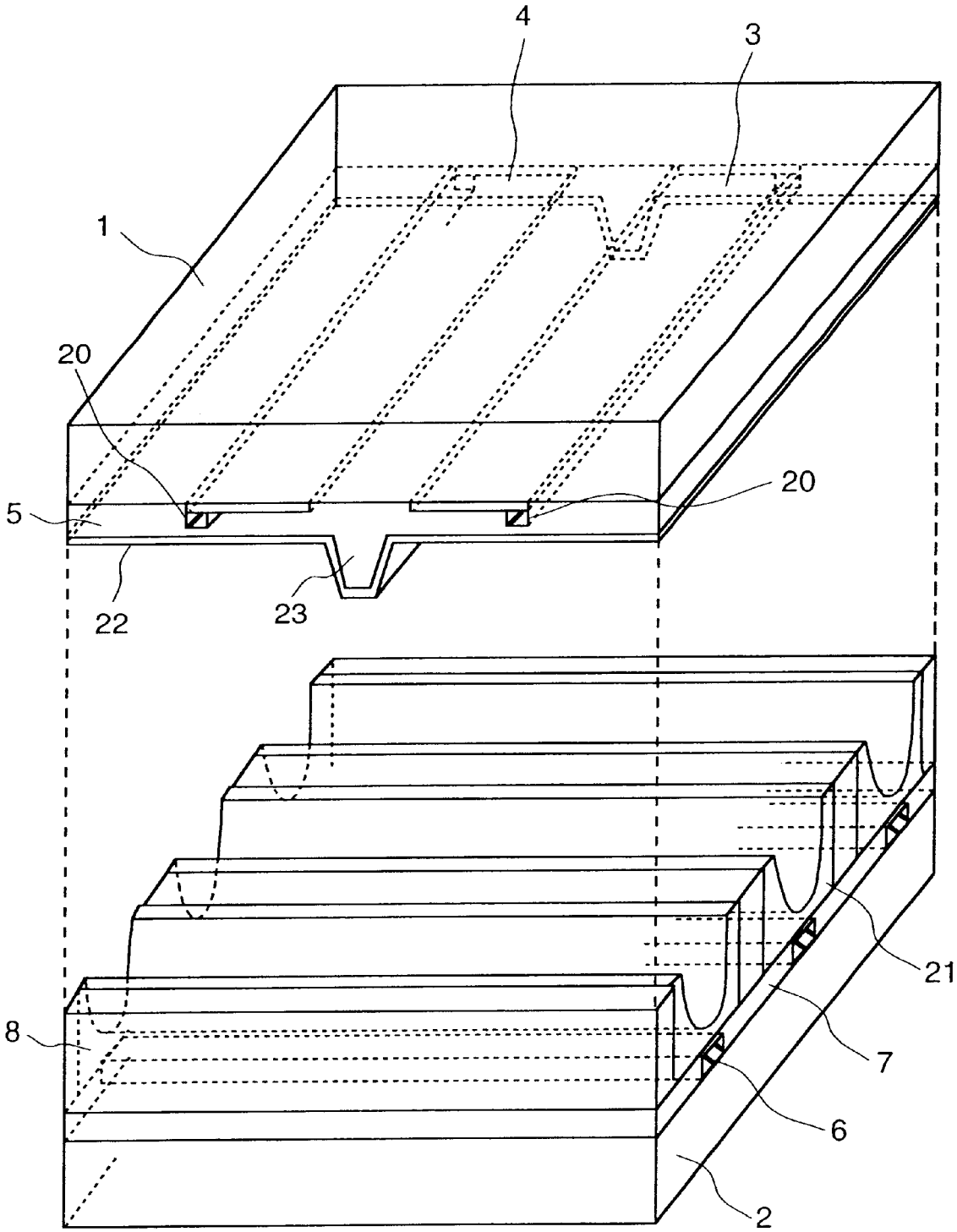
FIG. 7 is an exploded perspective view of a discharge cell in a PDP representing another embodiment, in which a dielectric barrier rib is formed, according to the present invention.

Next, a discharge cell of an embodiment according to the present invention, in which a dielectric rib 23 of 50–60 $\mu$m height is formed between the X and Y sustain electrodes as shown in FIG. 1, will be described. FIG. 1 shows a vertical cross sectional view of a discharge cell in a PDP representing an embodiment according to the present invention. Reference numbers 26 and 27 indicate the height h and the width w of the discharge space 9, respectively. Address electrodes 6 are formed on the back face glass substrate 2. A plurality of parallel address electrodes are generally formed to compose a plurality of subcells as shown in FIG. 7, for example. Moreover, the address electrodes 6 are covered by the dielectric layer 7. A fluorescent layer 21 is situated at the side, facing the discharge space 9, of the dielectric layer 7. Further, the top face glass substrate 1 is located opposite the back face glass substrate 2 at a distance from the discharge space 9. The X and Y sustain electrodes 3 and 4, which are transparent electrodes, are disposed at the side facing the discharge space 9. Furthermore, bus electrodes 20 are formed at the X and Y sustain electrodes 3 and 4, respectively. Although not shown in FIG. 1, to compose the plural subcells, plural groups of electrodes are formed by the X and Y sustain electrodes and the address electrodes 6. The address electrodes 6 are opposed to the X and Y sustain electrodes 3 and 4 on which the bus electrodes 20 are formed, in solid crossing at a distance from the discharge space 9. Moreover, the dielectric layer 5 is formed on the top face glass substrate 1 so that it covers the X and Y sustain electrodes 3 and 4 as well as the bus electrodes 20. A secondary electron-emitting layer 22 is formed on the dielectric layer on the substrate 1. The dielectric rib 23 is formed at the place corresponding to the middle position between the X and Y sustain electrodes 3 and 4, projecting from the dielectric layer 5 toward the back face glass substrate 2, and its surface is also covered with the secondary electron-emitting layer 22. In other words, the thickness of the dielectric layer 5 is larger at the place corresponding to the middle position between the X and Y sustain electrodes 3 and 4 than the other region. Since the dielectric rib 23 is formed so as to project toward the substrate 2, the electric flux lines 24 between the X and Y sustain electrodes 3 and 4 are formed in an arc shape, straddling the dielectric rib 23, before discharging. Thus, the shape of the plasma distribution becomes the shape indicated by reference number 25.

It is desirable to form the dielectric layer 5 or to cover the surface of the dielectric layer 5, with material which reflects ultraviolet rays, from the view point of efficiently transporting the radiated ultraviolet rays to the surface of the fluorescent layer 21. Also, it is desirable to cover the surface of the dielectric layer 5 with material which emits secondary electrons from the view point of stabilizing the discharge by decreasing the discharge initiation voltage to as low a level as possible. In this structure, the effective electric flux lines 24 before discharging are generated as shown in FIG. 1. Accordingly, the plasma distribution due to the sustain discharge has shape which is bent at its center. As a similar phenomenon to this plasma distribution, there is a phenomenon in which plasma in a thin tube changes its shape along the inside wall of the tube even if the tube is bent. It is interpreted that the plasma distribution 25 shown in FIG. 1 is obtained by folding the plasma between two electrodes disposed opposite each other, into the plasma between the X and Y coplanar electrodes.

Figure 4:
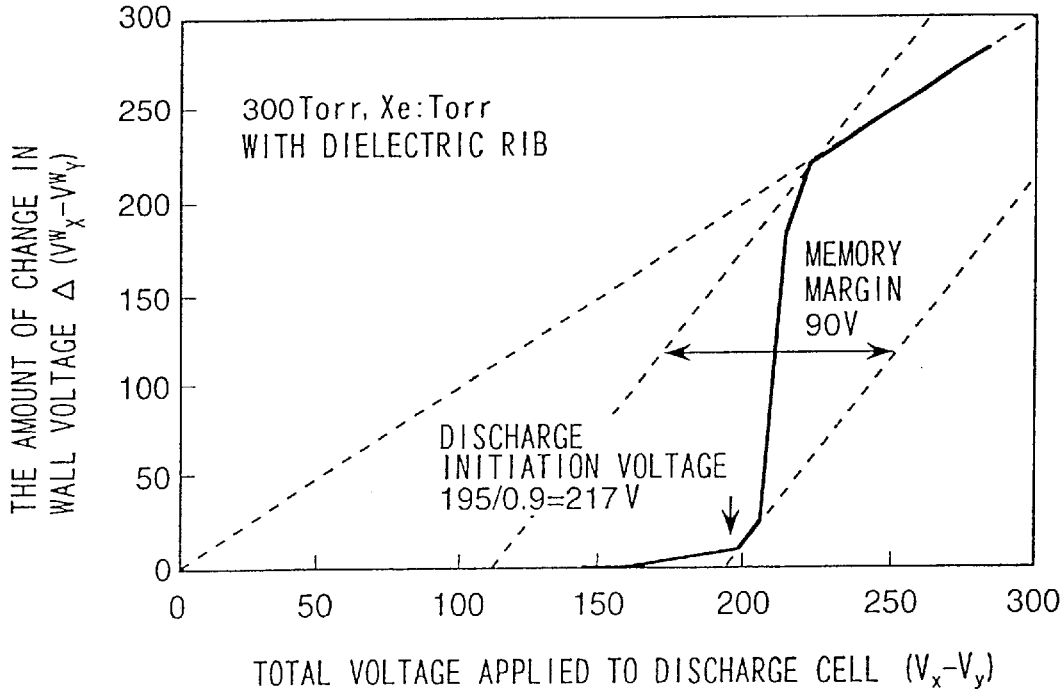
FIG. 4 is a graph indicating the change in the wall voltage of the sustain discharge under the condition of 18-Torr Xe partial pressure, in the structure shown in FIG. 1.

FIG. 4 shows a graph indicating the change in wall voltage in the sustain discharge under the conditions in which the discharge space is filled with Xe gas of 18-Torr partial pressure, which radiates ultraviolet rays, and Ne gas of 300 Torr partial pressure, as a buffer gas which moderates the collisions of ions to the surface of the dielectric layers, in the structure shown in FIG. 1. The abscissa axis and the ordinate axis in FIG. 4 are the same as those in FIG. 3. From FIG. 4, the discharge initiation voltage, the memory margin, and the operating voltage are obtained as about 195V, 90V, and (105V–195V), respectively. Further, the discharge initiation voltage is determined as being about 217V by correcting 195V with a voltage drop in the dielectric layer. Also, the operating voltage is determined as being 156V by correcting 140V, which is obtained by adding 35V to the lowest operable voltage 105V, with a voltage drop in the dielectric layer. It is seen that the wall voltage change curve rises more rapidly in comparison with that, which is shown in FIG. 3, of the reference structure without the dielectric rib 23, and the memory margin is extended by about 20V in the low voltage direction. The discharge efficiency in the sustain discharge of this embodiment is about 6%, which improves the reference efficiency of 5% by 20%. Further, since the operating voltage is decreased by about 20V, the discharge efficiency can be improved by increasing the partial pressure of Xe gas which radiates ultraviolet rays. Although the upper limit of the Xe partial pressure has been 30 Torr, it has become possible to set the partial pressure of gas which radiates ultraviolet rays, such as Xe gas, to more than 30 Torr in accordance with this embodiment, which can further improve the discharge efficiency.

Figure 5:
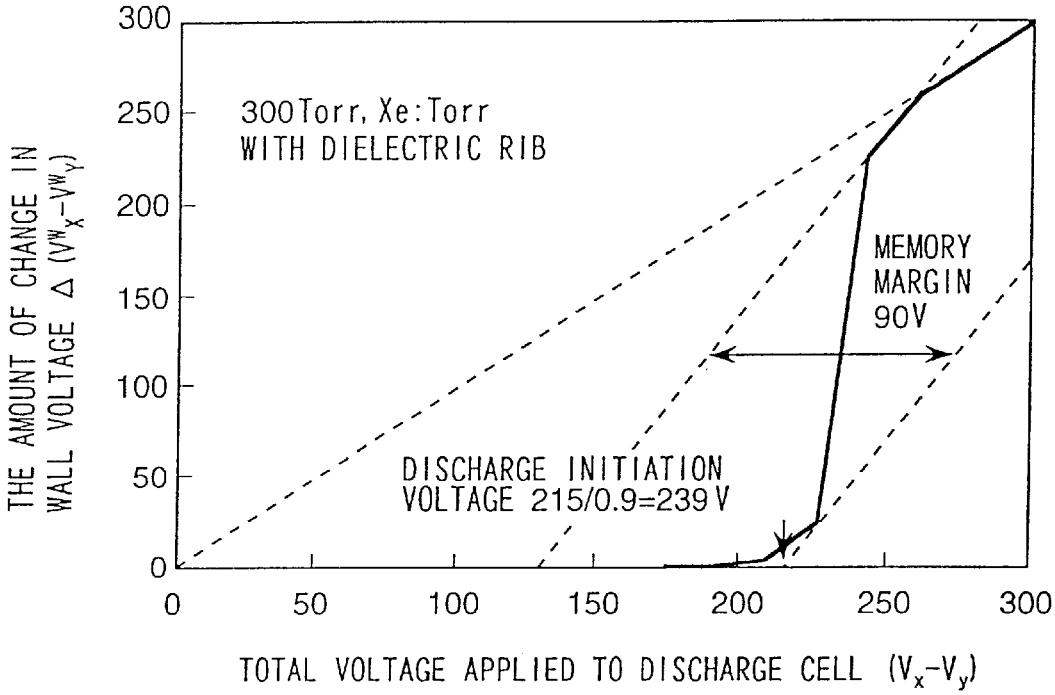
FIG. 5 is a graph indicating the change in the wall voltage of the sustain discharge under the condition of 66-Torr Xe partial pressure, in the structure shown in FIG. 1.

FIG. 5 shows a graph indicating the change in wall voltage in the sustain discharge in the case where the Xe partial pressure is increased to 66-Torr in a structure such as that shown in FIG. 2, in which the dielectric rib 23 is of the length 50–80 $\mu$m. The abscissa axis and the ordinate axis in FIG. 5 are the same as those in FIG. 3. From FIG. 5, the discharge initiation voltage, the memory margin, and the operating voltage are obtained as about 215V, 90V, and (125V–215V), respectively. Further, the discharge initiation voltage is determined as being about 239V by correcting 215V with a voltage drop in the dielectric layer. Also, the operating voltage is determined as being 178V by correcting 160V, which is obtained by adding 35V to the lowest operable voltage 125 V, with a voltage drop in the dielectric layer. The shape of the wall voltage change curve is almost the same as that in FIG. 4. However, the curve wholly shifts by about 20V in the high voltage direction. Therefore, it is possible to drive the sustain discharge at the same operating voltage as that of the reference structure, with a sufficient margin.

Figure 6:
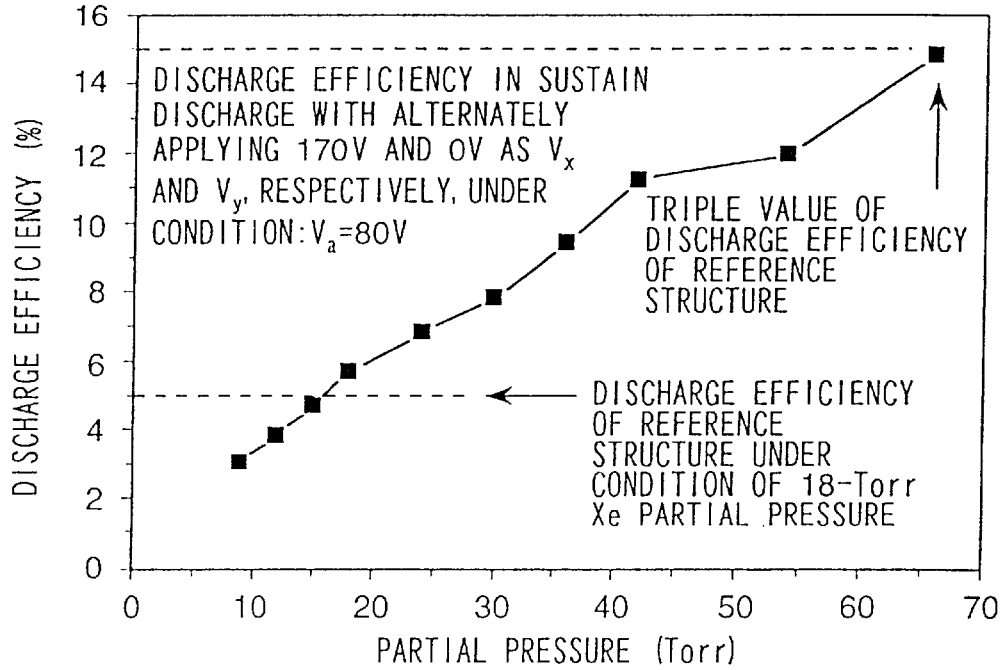
FIG. 6 is a graph indicating the relationship between the discharge efficiency and the Xe partial pressure, in the sustain discharge.

FIG. 6 is a graph indicating the relationship between the discharge efficiency in the sustain discharge and the partial pressure of Xe gas which radiates ultraviolet rays in a structure such as that shown in FIG. 2, in which the dielectric rib 23 is of the length 50–80 $\mu$m. The abscissa axis and the ordinate axis indicate the Xe partial pressure (Torr) and the discharge efficiency (%). The partial pressure of the buffer gas Ne is assumed as constant at 300 Torr. The operating voltage is the same as the reference voltage for the discharge cell of the reference structure, and 178V and 0V are alternately applied to the two sustain electrodes while keeping the address voltage at 80V. From FIG. 6, it is seen that the discharge efficiency monotonously increases as the Xe partial pressure increases. The discharge efficiency is 15% at 66 Torr of the Xe partial pressure, and reaches three times the reference efficiency of 5%. Also, the discharge efficiency is about 5% at 15 Torr of the Xe partial pressure. Further, it is 6% at 18 Torr of the Xe partial pressure, which exceeds the reference efficiency of 5%. Furthermore, the values of the discharge efficiency are about 7, 8, 9.5, 11, and 12% at 24, 30, 36, 42, and 54 Torr of the Xe partial pressure, respectively. The above results indicate that a great improvement in the discharge efficiency of the sustain discharge is possible without increasing the operating voltage. Moreover, it is desirable to set the Xe partial pressure to the range of 18–66 Torr and 42–66 Torr in order to achieve more than twice and three times the reference discharge efficiency, respectively.

If the height 26 of the discharge space 9 in the structure shown in FIG. 1, in which the dielectric rib 23 is formed, is the same as that in the reference structure shown in FIG. 2, the region of high plasma density is too near the surface of the fluorescent layer, which causes a problem in that the fluorescent layer suffers damage due to the collisions of ions. In order to avoid the above problem, it is favorable to set the ratio (h/w) of the gap between the surface of the dielectric layer at the sustain electrodes in the top face substrate 1 and the surface of the fluorescent layer in the back face substrate 2, that is, the height (h) 26, to the length (w) of one side of each pixel, to more than 0.2. In this way, since the region of high plasma density is far enough from the surface of the fluorescent layer, the problem in which the fluorescent layer suffers damage due to collisions of ions does not occur. However, if the height of the dielectric rib 23 is too large, which causes a large gap between the Y (sustain) electrodes and the A (address) electrodes, the operating voltage for the discharge becomes larger than practical. Accordingly, it is desirable to determine the ratio h/w under the condition that the operating voltage for the discharge does not exceed a practical value.

The PDP of the discharge cells of this embodiment can be fabricated by slightly increased processes in comparison with that of the discharge cells of the reference structure as follows. At first, the substrates 1 and 2 are fabricated in the same manner as those of the reference structure. Next, a lattice type dielectric barrier part or a rib type dielectric barrier part is formed between the X and Y sustain electrodes 3 and 4 by screen printing, and this part is covered with a secondary electron-emission layer. If the height of the lattice type dielectric barrier part or the rib type dielectric barrier part is 50–60 $\mu$m, screen-printing a few times will be sufficient. Further, the substrate 1 is aligned with the substrate 2, and they are sealed. If the rib type barrier part is formed, the positioning of the substrates 1 and 2 is not required to be different from the lattice type barrier part. Therefore, this type barrier part can be more easily fabricated. Last, the discharge space 9 in the cell is filled with the gas which radiates ultraviolet rays and the buffer gas,.

FIG. 7 shows a perspective view of a discharge cell in a PDP of a structure having a rib type barrier part (e.g., a dielectric barrier rib 23). The top face glass substrate 1 is assembled with the back face glass substrate 2, so that they are disposed opposite to each other. The transparent X and Y sustain electrodes 3 and 4 are formed on the side, opposite to the substrate 2, of the substrate 1. The bus electrodes 20 are formed on the partial regions of the respective X and Y sustain electrodes 3 and 4. The dielectric barrier rib 23 is formed between the X and Y sustain electrodes 3 and 4. The region besides the region on which the dielectric barrier rib 23 is formed, on the substrate 1, is covered with the dielectric layer (the dielectric layer 5 for the substrate 1). Further, the dielectric layer 5 is covered with the secondary electron-emission layer 22. On the other hand, the address electrodes 6 are formed on the side, opposite to the substrate 1, of the substrate 2, and they are covered with the dielectric layer 7. Barrier parts (e.g. back face barrier ribs 8) for creating groove spaces in the discharge space 9 are formed in parallel to the address electrodes 6. A fluorescent layer 21 is formed on the inside surface of each groove barrier part.

However, in a structure such as that shown in FIG. 7, cross-talk between the neighboring cells may occur. That is, by forming the dielectric barrier rib 23 between the X and Y sustain electrodes 3 and 4, cross-talk with the next cell may be increased depending on the cell-driving conditions. In order to prevent this cross-talk, it is desirable to form a boundary dielectric barrier rib 34 near the boundary of two neighboring discharge cells. The cross-talk can be remarkably reduced by this boundary dielectric barrier rib 34.

Figure 8:
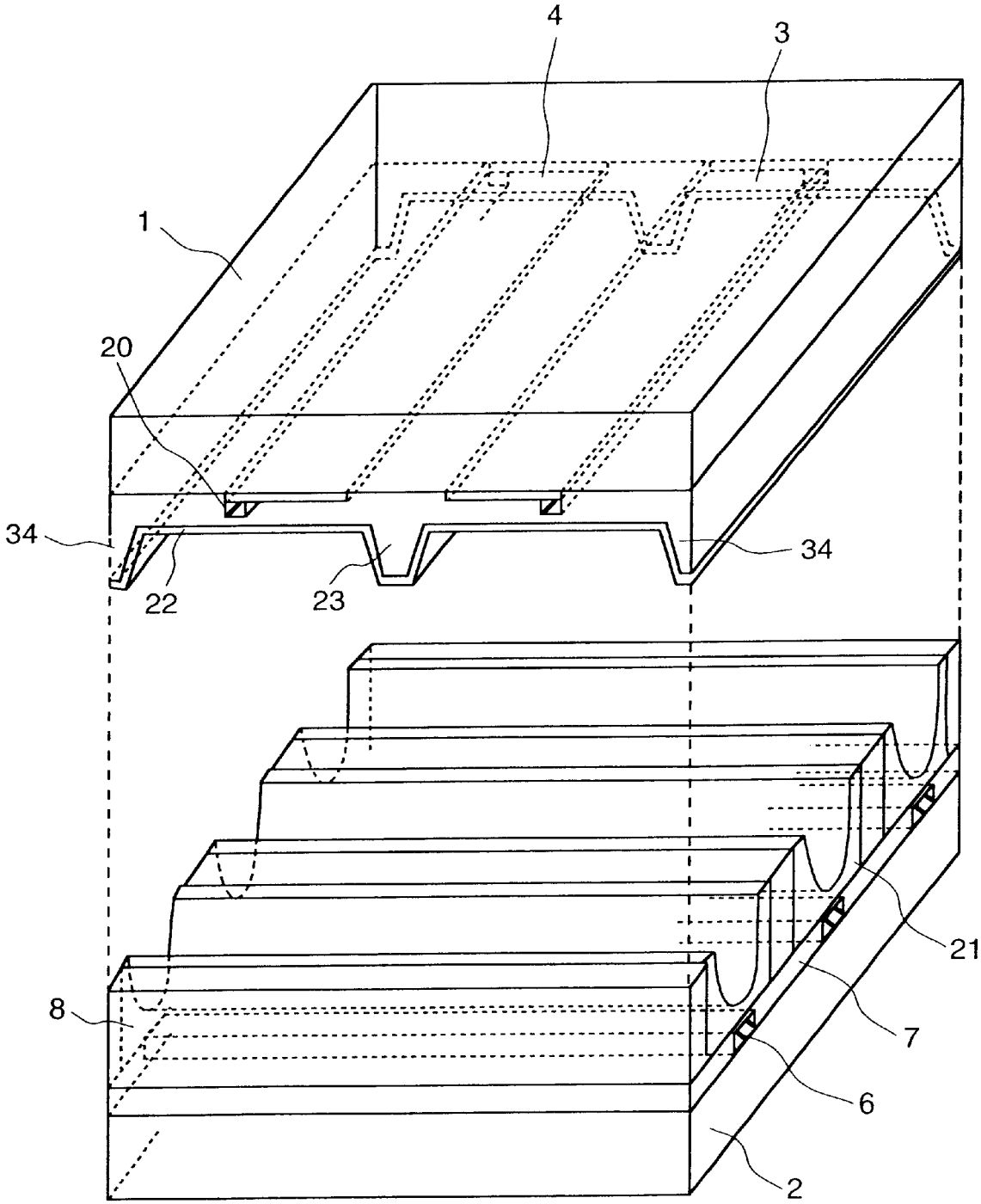
FIG. 8 is an exploded perspective view of a discharge cell in a PDP representing still another embodiment, in which a means for preventing cross-talk is provided, according to the present invention.

FIG. 8 is a perspective view of a discharge cell in a PDP representing another embodiment, in which the boundary dielectric barrier rib 34 for preventing cross-talk is provided. The fundamental structure of the cell shown in FIG. 8 is the same as that shown in FIG. 7. The center line of each boundary dielectric barrier rib 34 is positioned at the boundary line of two neighboring cells, as shown in FIG. 8.

Moreover, in a structure such as that shown in FIG. 7 or FIG. 8, cross-talk between the subcells in the direction of the sustain electrodes may occur in the sustain discharge period. In order to prevent this cross-talk, it is desirable to sufficiently decrease the width of the sustain electrodes at regions at which the sustain electrodes contact the respective dielectric barrier ribs 21 on the substrate 2. By this shape of the sustain electrodes, the spread of the sustain discharge can be prevented, which can effectively reduce this cross-talk.

Figure 9:
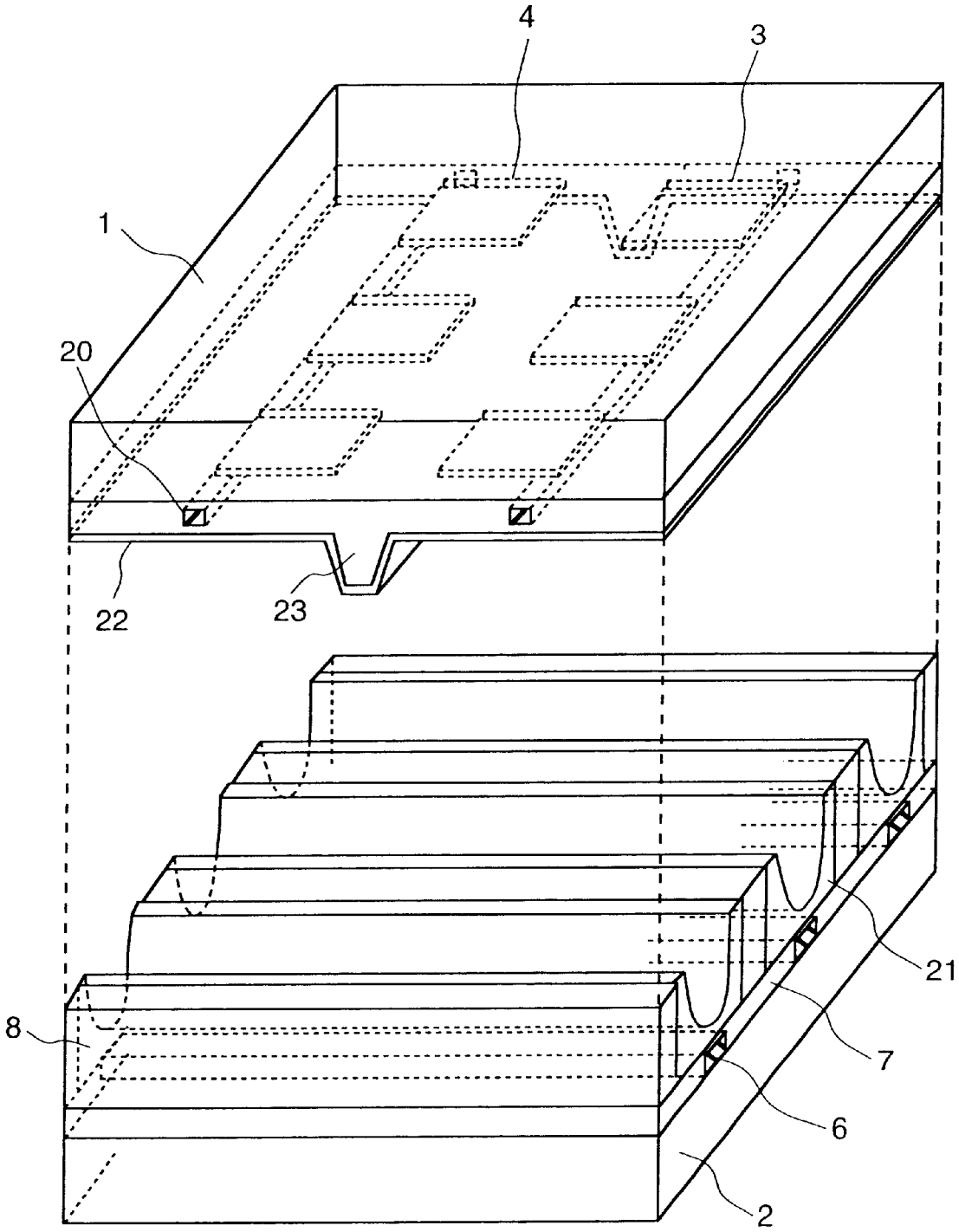
FIG. 9 is an exploded perspective view of a discharge cell in a PDP representing a further embodiment, in which a means for preventing cross-talk is provided, according to the present invention.

FIG. 9 shows a perspective view of a discharge cell in a PDP of another embodiment, in which the transparent sustain electrodes at regions at which the sustain electrodes contact the respective dielectric back face barrier ribs 8 on the substrate 2 are removed. That is, in the structure in which the width of the X and Y sustain electrodes at regions at which these electrodes contact the respective dielectric back face barrier ribs 8 on the substrate 2, is sufficiently reduced, the width is set to 0 in the example shown in FIG. 9. Meanwhile, the discrete electrode areas in all sustain electrodes are electrically connected by each bus electrode 20. Since the positioning of cells in the direction of the sustain electrodes is necessary, the fabrication of the PDP composed of cells with this structure shown in FIG. 9 becomes somewhat more difficult.

Preventing cross-talk in both directions of the sustain electrodes and the address electrodes is achieved by combining both structures shown in FIG. 8 and FIG. 9.

Here, the plasma display apparatus which uses the above-described PDP includes a drive unit for driving the PDP. Specifically, the drive unit includes drive circuits for driving the X and Y sustain electrodes, and the address electrodes, respectively, and a control device for controlling these drive circuits. Further, the plasma display apparatus includes a storage device for storing data to be displayed and/or an input device for inputting data to be displayed, from an external apparatus. This storage device, and the input device, can be composed using a microprocessor (MPU), a DVD memory, or a frame memory.

As described above, in accordance with the present invention, it is possible to generate plasma stably without increasing the operating voltage in the address or sustain discharge, and without causing the problem of damage to the fluorescent layer due to ion collisions, and this can remarkably improve the discharge efficiency. Thus, it has become possible to provide a three-electrode surface discharge type PDP which can stably display an image with high brightness, high gradation, and low power consumption.

What is claimed is:

1. A plasma display panel comprising:

a first substrate including a first dielectric material layer which covers a plurality of address electrodes, back face barrier ribs, each of which is located between two neighboring address electrodes, a fluorescent material layer which covers said back face barrier ribs and said first dielectric material layer; and a second substrate including plural pairs of X sustain electrodes and Y sustain electrodes, which are arranged crossing at right angles to said address electrodes, and a second dielectric material layer which covers said sustain electrodes;

wherein said first substrate is arranged opposite to said second substrate via a discharge space which is filled with gas for radiating ultraviolet rays to make said fluorescent material layer emit light and buffer gas, and the thickness of said second dielectric layer in said second substrate is set larger, at a portion between a respective pair of said X and Y sustain electrodes, than that at other portions in said second dielectric layer.

2. A plasma display panel according to claim 1, wherein the partial pressure of said gas for radiating ultraviolet rays to make said fluorescent material layer emit light, is more than 30 Torr.

3. A plasma display panel according to claim 1, wherein the ratio h/w of; the distance h between the outer surface of said second dielectric material layer on said sustain electrodes in said second substrate and the outer surface of said fluorescent material layer in said first substrate, to the width w of each pixel of said display panel; is more than 0.2.

4. A plasma display panel according to claim 1, wherein each dielectric barrier rib is located at a boundary between two neighboring discharge cells in said display panel in order to prevent cross-talk from occurring between said two neighboring discharge cells in the direction of said address electrodes.

5. A plasma display panel according to claim 1, wherein the width of said sustain electrodes is set narrower, in regions of said respective sustain electrodes, in which said respective back face barrier ribs are opposite to said sustain electrodes, than that in other regions of said sustain electrodes in order to prevent cross-talk from occurring between said two neighboring discharge cells in the direction of said sustain electrodes.

6. A plasma display apparatus using a plasma display panel according to any one of claims 1 to 5.

7. A plasma display panel comprising:

a first substrate including a first dielectirc material layer which covers a plurality of address electrodes, back face barrier ribs, each of which is located between the neighboring address electrodes, a fluorescent material layer which covers said back face barrier ribs and said first dielectric material layer; and a second substrate including plural pairs of X sustain electrodes and Y sustain electrodes, which are arranged crossing at right angles to said address electrodes, and a second dielectric material layer which covers said sustain electrodes;

wherein said first substrate is arranged opposite to said second substrate via a discharge space which is filled with gas for radiating ultraviolet rays to make said fluorescent material layer emit light and buffer gas, and the thickness of said second dielectric layer portion between a respective pair of said X and Y sustain electrodes in said second substrate is set larger than that at other portions in said second dielectric layer, by forming the dielectric portion between said X and Y sustain electrodes as a convex shape projecting toward said space in which plasma is generated.

8. A plasma display panel according to claim 7, wherein the partial pressure of said gas for radiating ultraviolet rays to make said fluorescent material layer emit light, is more than 30 Torr.

9. A plasma display panel according to claim 7, wherein the ratio h/w of; the distance h between the outer surface of said second dielectric material layer on said sustain electrodes in said second substrate and the outer surface of said fluorescent material layer in said first substrate, to the width w of each pixel of said display panel; is more than 0.2.

10. A plasma display panel according to claim 7, wherein each dielectric barrier rib is located at a boundary between two neighboring discharge cells in said display panel in order to prevent cross-talk from occurring between said two neighboring discharge cells in the direction of said address electrodes.

11. A plasma display panel according to claim 7, wherein the width of said sustain electrodes is set narrower, in regions of said respective sustain electrodes, in which said respective back face barrier ribs are opposite to said sustain electrodes, than that in other regions of said sustain electrodes in order to prevent cross-talk from occurring between said two neighboring discharge cells in the direction of said sustain electrodes.

12. A plasma display apparatus using a plasma display panel according to any one of claims 7 to 11.

* * * * *